US008859049B2

(12) United States Patent
Jung et al.

(10) Patent No.: US 8,859,049 B2
(45) Date of Patent: Oct. 14, 2014

(54) PLATING METHOD FOR A RADIO FREQUENCY DEVICE AND A RADIO FREQUENCY DEVICE PRODUCED BY THE METHOD

(75) Inventors: Hyun-Yeong Jung, Incheon-si (KR); Myoung-Joon Jung, BBucheon-si (KR)

(73) Assignee: Ace Technologies Corp., Incheon-si (KR)

( * ) Notice: Subject to any disclaimer, the term of this patent is extended or adjusted under 35 U.S.C. 154(b) by 303 days.

(21) Appl. No.: 12/919,603

(22) PCT Filed: Feb. 27, 2009

(86) PCT No.: PCT/KR2009/000974

§ 371 (c)(1), (2), (4) Date: Aug. 26, 2010

(87) PCT Pub. No.: WO2009/108019

PCT Pub. Date: Sep. 3, 2009

(65) Prior Publication Data

US 2011/0005935 A1 Jan. 13, 2011

(30) Foreign Application Priority Data

Feb. 28, 2008 (KR) ..... 10-2008-0018469

(51) Int. Cl.

| | |
|---|---|
| ***B05B 5/00*** | (2006.01) |
| ***B05D 3/00*** | (2006.01) |
| ***B05D 3/12*** | (2006.01) |
| ***B05D 1/36*** | (2006.01) |
| ***B05D 1/00*** | (2006.01) |
| ***C25D 5/10*** | (2006.01) |
| ***C25D 5/34*** | (2006.01) |
| ***C25D 5/44*** | (2006.01) |
| ***C25D 11/16*** | (2006.01) |
| ***C23C 28/02*** | (2006.01) |
| ***C23C 28/00*** | (2006.01) |
| *C25D 3/38* | (2006.01) |
| *C25D 7/00* | (2006.01) |

(52) U.S. Cl.

CPC .. *C25D 5/10* (2013.01); *C25D 5/44* (2013.01); *C25D 3/38* (2013.01); *C25D 7/00* (2013.01)

USPC ..... 427/299; 427/158; 427/327; 427/402; 427/405; 205/170; 205/182; 205/184; 205/191; 205/205; 205/210; 205/213

(58) Field of Classification Search

USPC ..... 427/158, 299, 327, 402, 405; 205/170, 205/182, 184, 191, 205, 210, 213

See application file for complete search history.

(56) References Cited

U.S. PATENT DOCUMENTS 2,891,309 A * 6/1959 Fenster ..... 72/39
3,881,999 A * 5/1975 Toth et al. ..... 205/176

(Continued)

FOREIGN PATENT DOCUMENTS

JP 53097937 A * 8/1978 ..... C25D 3/46
JP 5195284 A 8/1993

(Continued)

OTHER PUBLICATIONS

International Search Report dated Sep. 22, 2009 of WO2009/1080019A3.

*Primary Examiner* — Edna Wong
(74) *Attorney, Agent, or Firm* — Duane Morris LLP

(57) ABSTRACT

A plating method for an RF device is disclosed. The method includes (a) pre-treating the RF device made from a substrate material; (b) forming a copper plating layer by applying copper plating to the RF device; and (c) forming a thin-film layer over the copper plating layer, the thin-film layer made of a precious metal, where a thickness of the precious-metal thin-film layer is thinner than a skin depth at a working frequency band. The disclosed method makes it possible to provide a plating treatment with a low cost while providing a superior appearance quality.

7 Claims, 4 Drawing Sheets

(56) References Cited

U.S. PATENT DOCUMENTS

| | | | | | |
|---|---|---|---|---|---|
| 4,537,846 | A * | 8/1985 | Mimura et al. | ..... | 430/58.1 |
| 4,919,774 | A * | 4/1990 | Minato et al. | ..... | 205/651 |
| 5,304,962 | A * | 4/1994 | Bobadilla et al. | ..... | 333/134 |
| 6,391,168 | B1 * | 5/2002 | Ueno | ..... | 204/242 |
| 2006/0243598 | A1 * | 11/2006 | Singh et al. | ..... | 205/260 |

FOREIGN PATENT DOCUMENTS

| | | | | | |
|---|---|---|---|---|---|
| JP | 07180085 | A * | 7/1995 | ..... | C25D 5/10 |
| KR | 20000051998 | A * | 8/2000 | ..... | C25D 3/46 |
| KR | 100794804 | B1 | 1/2008 | | |
| KR | 1020000051998 | A | 8/2008 | | |

* cited by examiner

PLATING METHOD FOR A RADIO FREQUENCY DEVICE AND A RADIO FREQUENCY DEVICE PRODUCED BY THE METHOD

CROSS-REFERENCE TO RELATED PATENT APPLICATIONS

The present application is a U.S. national stage application under 35 U.S.C. §371 of PCT Application No. PCT/KR2009/00974, filed Feb. 27, 2009, the entirety of which is incorporated herein by reference.

BACKGROUND

1. Technical Field

The present invention relates to a plating method, more particularly to a plating method for a radio frequency (RF) device and to a radio frequency device produced by this method.

2. Description of the Related Art

As a result of developments in mobile communication, optical communication, and satellite communication, as well as the popularization of mobile communication terminals, various types of RF devices for processing RF signals, such as filters, duplexers, waveguides, etc., are being mass-produced.

When processing high-frequency RF signals, such as microwaves, there may be an occurrence of the "skin effect," which describes the phenomenon of the high-frequency current becoming maximum at the surface. In order to obtain the desired properties in a desired frequency range, an RF device for processing high-frequency RF signals must be capable of reducing alternating current loss. For this purpose, a plating process of plating an interior of the RF device may be selected, where silver plating is generally performed.

Typically, the factors affecting alternating current loss in a high-frequency RF device are known to be the surface roughness of the internal surfaces of the waveguide and the plating method. Thus, to reduce loss, there is a need to use a plating method that is appropriate for a product having a complicated shape, as well as to select a suitable plating liquid.

By using a suitable plating treatment, it is necessary to provide uniform deposition properties and good skin smoothness, lower electrical resistance, and increase adhesion strength to the substrate layer.

The thickness of the plating layer is also closely related to a physical property, i.e. the skin effect in high-frequency ranges. The skin depth according to the skin effect can be expressed by Equation 1.

$$\frac{1}{\sqrt{\pi f \mu \sigma}} \quad \text{[Equation 1]}$$

In Equation 1 above, $\pi$ is a constant, $\mu$ is magnetic permeability, f is frequency, and $\sigma$ is electrical conductivity.

The RF devices to which a silver plating treatment is applied are usually first shaped from aluminum or an aluminum alloy and afterwards are subject to the silver plating treatment. In general, an RF device was produced by fabricating its shape from aluminum or an aluminum alloy using casts, etc., and then immersing the shape in a plating liquid.

While this method of silver-plating an RF device may be advantageous in terms of loss and appearance quality, the method may incur high costs and thus may not provide an economical advantage.

In recent times, there have been attempts to use copper plating as a substitute for the expensive silver plating, but copper plating may not provide desirable properties in terms of appearance quality, in relation to aesthetics and oxidation.

SUMMARY

To resolve the problems described above, an objective of the invention is to provide a plating method for an RF device and an RF device produced by this method, with which the plating treatment can be provided with a low cost.

Another objective of the invention is to provide a plating method for an RF device and an RF device produced by this method, which can provide the plating treatment with a low cost while providing a high appearance quality.

The skilled person will be able to deduce other objectives of the invention from the descriptions that follow.

To achieve the above objectives, an aspect of the invention provides a plating method for an RF device that includes: (a) pre-treating the RF device made from a substrate material; (b) forming a copper plating layer by applying copper plating to the RF device; and (c) forming a thin-film layer over the copper plating layer, the thin-film layer made of a precious metal, where a thickness of the precious-metal thin-film layer is thinner than a skin depth at a working frequency band.

The substrate material can include aluminum and aluminum alloys.

A thickness of the copper plating layer can be set to be thicker than a skin depth at a working frequency band.

The thickness of the precious-metal thin-film layer can be 0.2 to 1 μm.

The precious metal can be any one selected from a group consisting of silver, gold, and platinum, or a combination thereof.

The precious-metal thin-film layer may preferably be formed by an electroplating method at a low voltage.

The precious-metal thin-film layer can be formed by any one method selected from a group consisting of wet plating, sputtering, arc ion plating, dry plating using vacuum ion deposition, and painting including printing.

The copper plating in operation (b) may preferably be performed using an alkaline copper pyrophosphate or a copper sulfate, including $Cu(BF_4)_2$, $CuSO_4$.

The copper plating in operation (b) may preferably be performed using an additional auxiliary electrode.

When performing the copper plating in operation (b), the ratio of a current caused by a main power source for a main electrode to a current caused by an auxiliary power source for the auxiliary electrode may preferably be set to 1:2.

Another aspect of the invention provides an RF device that is applied with a plating treatment according to the methods described above.

Certain embodiments of the invention make it possible to provide a plating treatment with a low cost while providing a superior appearance quality.

Additional aspects and advantages of the present invention will be set forth part in the description which follows, and in part will be obvious from the description, or may be learned by practice of the invention.

DETAILED DESCRIPTION

The plating method for an RF device, as well as the RF device produced by the plating method, according to certain preferred embodiments of the invention will be described below in more detail with reference to the accompanying drawings.

Before describing the invention, the plating layers of a conventional RF device will first be examined.

Figure 1:
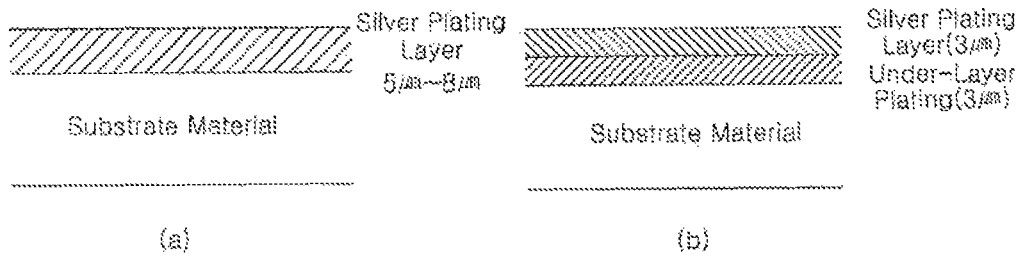
FIG. 1(*a*) and FIG. 1(*b*) illustrate the plating layers of a conventional RF device.

FIG. 1(*a*) and FIG. 1(*b*) illustrate the plating layers of a conventional RF device.

FIG. 1(*a*) illustrates the plating layer of an RF device to which only silver plating has been applied, while FIG. 1(*b*) illustrates the plating layers of an RF device to which both under-layer plating and silver plating have been applied.

Referring to FIG. 1(*a*) and FIG. 1(*b*), it is typical, in the related art, to perform only silver plating to an RF device made of an aluminum or aluminum alloy material as in FIG. 1(*a*), or to first apply a under-layer plating treatment to the aluminum or aluminum alloy material and afterwards apply a silver plating treatment over the strike as in FIG. 1(*b*).

Copper is mainly used as the material for the under-layer plating. The under-layer plating is performed mainly to improve plating adhesion, and the copper used as the under-layer plating material does not affect RF properties.

As illustrated in FIGS. 1(*a*) and 1(*b*), in the related art, when only silver plating treatment is applied, the plating may be performed such that the thickness is 5 to 8 μm at a band of 800 MHz, and when copper under-layer plating and silver plating are applied together, the plating may be performed such that the thickness of the copper plating and the thickness of the silver plating are about 3 μm.

Such plating thicknesses may be set considering the fact that the skin depth of silver at the 800 MHz band is approximately 2.27 μm.

Thus, in the related art, an RF device made of an aluminum or an aluminum alloy material may be subject to silver plating only, or to silver plating and under-layer plating for improving plating adhesion, with the RF properties being determined only by the silver.

As already mentioned above, these conventional methods of silver plating may incur high costs, because large amounts of silver are needed, and silver is expensive.

In response to these problems, there have been attempts to use copper plating, but copper plating could not provide high reliability in terms of appearance quality, in relation to aesthetics, oxidation, and contamination-resistance. That is, an RF device treated with copper plating may not be aesthetically pleasing in appearance, and may also easily be subject to oxidation and contamination.

Figure 2:
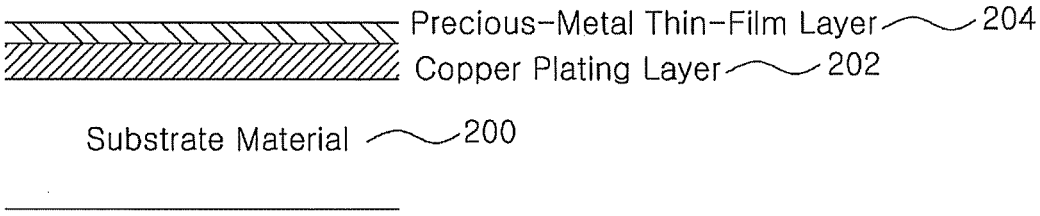
FIG. 2 illustrates plating layers formed by a plating method according to a preferred embodiment of the invention.

FIG. 2 illustrates plating layers formed by a plating method according to a preferred embodiment of the invention.

Referring to FIG. 2, the plating layers according to an embodiment of the invention can include a substrate layer 200, a copper plating layer 202, and a thin-film precious-metal layer 204. The substrate material can generally be aluminum or an aluminum alloy.

In FIG. 2, the copper plating layer 202 plated over the substrate layer 200 can have a thickness of 8 to 10 μm at a band of about 800 MHz. The copper plating layer 202 can be formed by a typical electroplating method. The thickness of the copper plating layer 202 may be set to the thicker than the skin depth of the working frequency band.

The precious-metal layer 204 may be coated over the copper plating layer 202 such that its thickness is 0.2 to 1 μm. The thickness of the thin-film precious-metal layer 204 may be set substantially thinner, compared to the skin depth at the working frequency band. Here, the metals that can be used for the precious-metal layer can include precious metals such as silver, gold, and platinum, and preferably, silver can be used.

In an embodiment of the invention, the thin-film precious-metal layer 204 is not involved with RF properties and serves only to maintain appearance quality. Since the thickness of the thin-film precious-metal layer 204 is set to be thinner than the skin depth at the working frequency band, it cannot affect RF properties such as loss, and only affects the appearance quality, such as aesthetics, oxidation, and contamination-resistance.

RF properties such as the skin effect and loss, etc., may be determined by the copper forming the copper plating layer 202, and the thickness of the copper plating layer 202 may be set in consideration of the skin depth.

Since precious metals such as silver, gold, and platinum can have superior properties than those of copper in terms of oxidation and contamination-resistance and are also more appealing in appearance, problems related to oxidation and contamination in an ambient environment can be better avoided compared to the conventional plating method of using only copper plating.

In an embodiment of the invention, the desired RF properties can be provided by the copper plating layer 202, in a similar fashion to typical copper plating, while the reliability in terms of appearance quality, which is a weak point in copper plating, can be complemented by the thin-film precious-metal layer 204.

Since the thin-film precious-metal layer 204 is formed thinly, an extremely small amount of precious metal may be used, which does not incur high cost. Therefore, the advantage of copper plating, namely, low cost, can be maintained while at the same time improving appearance quality.

The plating method according to an embodiment of the invention can be applied to various types of RF devices, such an RF filter, a TMA (tower-mounted amplifier), a waveguide, a duplexer, a diplexer, a bias tee, etc. A description will now be provided below on the detailed procedures of a plating method according to an embodiment of the invention.

Figure 3:
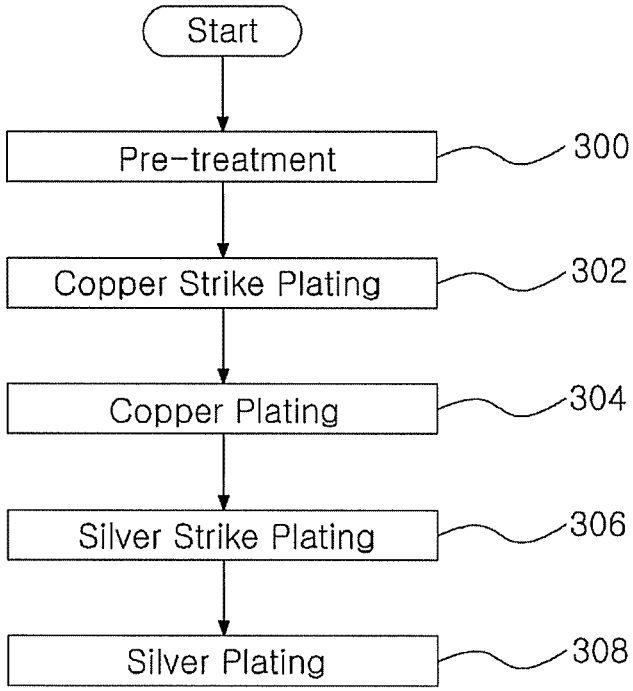
FIG. 3 is a flowchart illustrating the overall flow of a plating method for an RF device according to an embodiment of the invention.

FIG. 3 is a flowchart illustrating the overall flow of a plating method for an RF device according to an embodiment of the invention.

Referring to FIG. 3, a pre-treatment process may first be performed (operation 300). The pre-treatment process may include removing impurities from the substrate material and leveling the surfaces that are to be plated, in order to provide a suitable plating.

Figure 4:
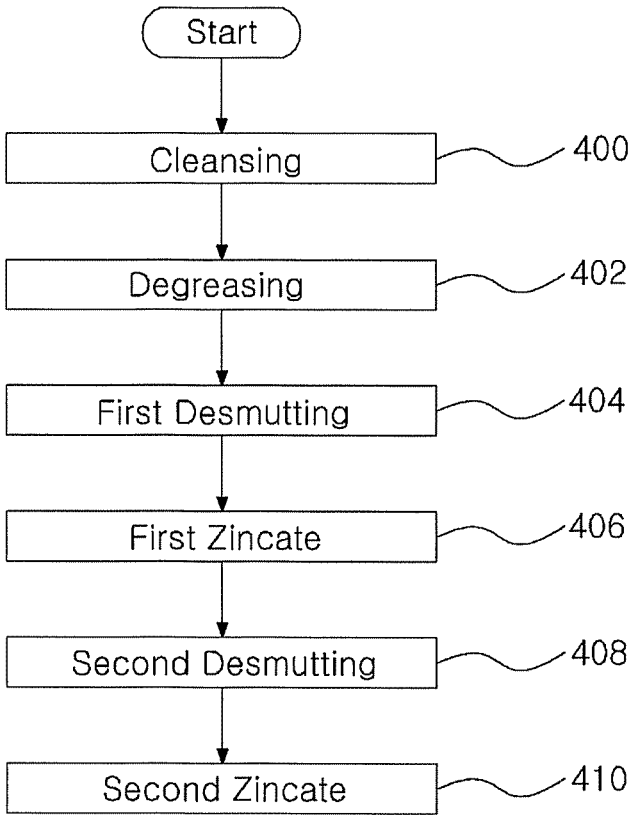
FIG. 4 is a flowchart illustrating a pre-treatment operation according to an embodiment of the invention.

FIG. 4 is a flowchart illustrating a pre-treatment operation according to an embodiment of the invention.

Referring to FIG. 4, a TCE cleansing process may first be performed (operation 400). The TCE cleansing process may serve to remove cutting fluid, mold impurities, fingerprints, etc.

After the TCE cleansing process, a degreasing process may be performed (operation 402). The degreasing process may be for removing impurities or organisms, etc., that are attached to the substrate material. Impurities attached to a surface of the substrate material can cause defective plating adhesion and can form an uneven plating layer, and thus a process for removing impurities may be performed. The types of degreasing methods may include ultrasonic degreasing and alkaline degreasing. Either one or both of the two types can be performed.

When the degreasing process is complete, a first desmutting process may be performed (operation 404). A desmutting process is for improving plating adhesion by removing an oxide film that may have formed on a surface of the substrate and neutralizing the substrate material that may have been alkalized using a strong acid. The desmutting process can be performed multiple times as necessary.

When the first desmutting process is complete, a first zincate treatment process may be performed on the substrate material (operation 406).

A zincate treatment is a method of treatment that makes it possible to apply electroplating or electroless plating directly on a metal or metal alloy. According to an embodiment of the invention, the first zincate treatment can be performed for 20 to 30 seconds in a 100% zincate solution having a pH of 0.5 to 1.5.

When the first zincate treatment is complete, a second desmutting process may be performed (operation 408). When the second desmutting process is complete, a second zincate treatment may be performed (operation 410), where the second zincate treatment can be performed for 20 to 30 seconds in a 100% zincate solution having a pH of 12 to 13.

When the pre-treatment process, such as that described above, is completed, a copper strike plating may be performed (operation 302) for forming a plating nucleus.

When the copper strike plating is complete, a copper plating process may be performed (operation 304). The copper plating may be an electroplating process. Electroplating involves placing electrodes in a solution containing metal ions and applying a current, which causes the metal ions to be deposited at the cathode. Using this principle, a thin film of metal may be formed on a surface of the substrate object placed at the cathode.

Copper plating is a plating method known to the public and can be performed in various ways. According to a preferred embodiment of the invention, the copper plating can be performed using a copper pyrophosphate or a copper sulfate (e.g. $Cu(BF_4)_2$, $CuSO_4$) as the plating chemical. Since, in an embodiment of the invention, a thin-film precious-metal layer will be formed over the copper plating layer, it is preferable that a copper plating providing desirable roughness and smoothness characteristics be performed. Thus, rather than using copper cyanide, which is advantageous in terms of plating adhesion and speed, it may be preferable to perform the copper plating using a copper pyrophosphate or a copper sulfate. In cases where copper pyrophosphate is used, the pH of the copper pyrophosphate can be set to 8.0 to 9.5.

Also, according to a preferred embodiment of the invention, the copper plating may preferably be performed using an auxiliary electrode in addition to a main electrode. During copper plating, a problem may occur in which portions of the RF device are plated to different plating thicknesses. To prevent such plating deviations and improve plating speed, an auxiliary electrode (anode) may be used during the copper plating.

According to a more preferred embodiment of the invention, the ratio of the current created in the main electrode by a main power source to the current created in the auxiliary electrode by an auxiliary power source may be set to 1:2.

As described above, the copper may be plated to provide the RF properties for the RF device, and the plating treatment may be performed such that the copper has a sufficient thickness greater than the skin depth at the working frequency band.

When the copper plating is complete, a cleaning procedure may be performed and then a silver strike plating may be performed (operation 306) for forming a plating nucleus, and after the silver strike plating, silver plating may be performed (operation 308) for forming a thin film of a silver plating layer that maintains appearance quality.

Although FIG. 3 illustrates an example in which silver is used for the thin-film plating material that maintains appearance quality, precious metals other than silver, such as gold, platinum, etc., can also be used, as already described above.

According to an embodiment of the invention, the silver plating can be performed by electroplating using a potassium cyanide solution and a silver cyanide solution. Since the plating is to form a thin film of 1 μm or thinner, the plating can be performed within a short amount of time, of about 5 minutes.

Also, according to a preferred embodiment of the invention, the plating may preferably be performed at a relatively low voltage, so that the thin-film plating layer can have the property of high density.

Since the thin-film plating layer formed in this manner has a very thin thickness, it may not affect RF properties and may serve only to improve the appearance quality. The fact that the RF properties are determined by the copper plating layer below the thin-film layer is different from the existing silver plating method that uses copper plating as a under-layer plating.

The thin-film plating layer made of a precious metal can be obtained in various ways other than the electroplating method described above.

It will be apparent to the skilled person that various methods of forming a thin film can be used, such as wet plating, sputtering, arc ion plating, dry plating using vacuum ion deposition, and painting including printing, for example.

While the spirit of the invention has been described in detail with reference to particular embodiments, the embodiments are for illustrative purposes only and do not limit the invention. It is to be appreciated that those of ordinary skill in the art can make various modifications, alterations, and additions without departing from the scope and spirit of the invention and that such modifications, alterations, and additions are encompassed by the scope of claims below.

What is claimed is:

1. A plating method for an RF device, the plating method comprising:

(a) pre-treating the RF device made from a substrate material;

(b) forming a copper plating layer by applying copper plating to the RF device; and (c) forming a thin-film layer over the copper plating layer, the thin-film layer made of a precious metal, wherein a thickness of the precious-metal thin-film layer is thinner than a skin depth at a working frequency band and wherein a thickness of the copper plating layer is set to be thicker than the skin depth at the working frequency band, the skin depth being determined based on a working frequency, an electrical conductivity, and a magnetic permeability.

2. The plating method according to claim 1, wherein the substrate material includes aluminum or aluminum alloys.

3. The plating method according to claim 1, wherein a thickness of the precious-metal thin-film layer is 0.2 to 1 μm.

4. The plating method according to claim 1, wherein the precious metal is any one selected from a group consisting of silver, gold, and platinum, and a combination thereof.

5. The plating method according to claim 1, wherein the precious-metal thin-film layer is formed by an electroplating method at a low voltage.

6. The plating method according to claim 1, wherein the copper plating in operation (b) is performed using an alkaline copper pyrophosphate or one of $Cu(BF_4)_2$ and $CuSO_4$.

7. The plating method according to claim 6, wherein the copper plating in operation (b) is performed using an auxiliary electrode.

* * * * *